US006286149B1

(12) United States Patent
Whitaker

(10) Patent No.: US 6,286,149 B1
(45) Date of Patent: Sep. 11, 2001

(54) WIND DAMPENING DEVICE

(76) Inventor: Kevin D. Whitaker, 21 Evergreen St., Wakefield, MA (US) 01880

( * ) Notice: Subject to any disclaimer, the term of this patent is extended or adjusted under 35 U.S.C. 154(b) by 0 days.

(21) Appl. No.: 09/586,026

(22) Filed: Jun. 2, 2000

(51) Int. Cl.[7] ..... A61F 11/14; A42B 3/16
(52) U.S. Cl. ..... 2/209; 2/423
(58) Field of Search ..... 2/423, 209, 13, 2/422, 425, 9, 421, 410, 175.6, 909; 128/864, 866, 867; 351/123, 47, 122

(56) References Cited

U.S. PATENT DOCUMENTS

| | | | | |
|---|---|---|---|---|
| 389,735 | * | 9/1888 | Britton | 2/209 |
| 2,532,852 | * | 12/1950 | Oaks | 2/423 |
| 3,943,925 | * | 3/1976 | Leught | 2/423 |
| 4,037,273 | | 7/1977 | Labaire . | |
| 4,670,911 | * | 6/1987 | Dunford | 2/423 |
| 4,751,746 | * | 6/1988 | Rustin | 2/209 |
| 5,044,014 | * | 9/1991 | Cornale et al. | 2/423 |
| 5,086,789 | | 2/1992 | Tichy . | |
| 5,231,704 | * | 8/1993 | Hildenbrand | 2/209 |
| 5,323,493 | * | 6/1994 | Ogiba | 2/423 |
| 5,477,564 | * | 12/1995 | Tichy | 2/209 |
| 5,943,703 | * | 8/1999 | Avila, Jr. | 2/209 |
| 6,029,282 | * | 2/2000 | Buschman | 2/423 |

* cited by examiner

*Primary Examiner*—Amy B. Vanatta

(57) ABSTRACT

A wind dampening device for dampening the wind around the ear associated with traveling at high velocities. The wind dampening device includes a panel. The panel has a top edge, a front edge, a back edge, a facing side and a rear side. The panel generally has a triangular shape. The top and front edges are orientated generally perpendicular to each other. The rear side of the proximal portion is concave. A fastening means fastens the panel to the article.

7 Claims, 3 Drawing Sheets

WIND DAMPENING DEVICE

BACKGROUND OF THE INVENTION

1. Field of the Invention

The present invention relates to ear protectors and more particularly pertains to a new wind dampening device for dampening the wind around the ear associated with traveling at high velocities.

2. Description of the Prior Art

The use of ear protectors is known in the prior art. More specifically, ear protectors heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. Nos. 5,231,704; 5,477,564; 5,086,789; 4,037,273; and 4,670,911.

While these devices fulfill their respective, particular objectives and requirements, the aforementioned patents do not disclose a new wind dampening device. The inventive device includes a panel. The panel has a top edge, a front edge, a back edge, a facing side and a rear side. The panel generally has a triangular shape. The top and front edges are orientated generally perpendicular to each other. The rear side of the proximal portion is concave. A fastening means fastens the panel to the article.

In these respects, the wind dampening device according to the present invention substantially departs from the conventional concepts and designs of the prior art, and in so doing provides an apparatus primarily developed for the purpose of dampening the wind around the ear associated with traveling at high velocities.

SUMMARY OF THE INVENTION

In view of the foregoing disadvantages inherent in the known types of ear protectors now present in the prior art, the present invention provides a new wind dampening device construction wherein the same can be utilized for dampening the wind around the ear associated with traveling at high velocities.

The general purpose of the present invention, which will be described subsequently in greater detail, is to provide a new wind dampening device apparatus and method which has many of the advantages of the ear protectors mentioned heretofore and many novel features that result in a new wind dampening device which is not anticipated, rendered obvious, suggested, or even implied by any of the prior art ear protectors, either alone or in any combination thereof.

To attain this, the present invention generally comprises a panel. The panel has a top edge, a front edge, a back edge, a facing side and a rear side. The panel generally has a triangular shape. The top and front edges are orientated generally perpendicular to each other. The rear side of the proximal portion is concave. A fastening means fastens the panel to the article.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new wind dampening device apparatus and method which has many of the advantages of the ear protectors mentioned heretofore and many novel features that result in a new wind dampening device which is not anticipated, rendered obvious, suggested, or even implied by any of the prior art ear protectors, either alone or in any combination thereof.

It is another object of the present invention to provide a new wind dampening device which may be easily and efficiently manufactured and marketed.

It is a further object of the present invention to provide a new wind dampening device which is of a durable and reliable construction.

An even further object of the present invention is to provide a new wind dampening device which is susceptible of a low cost of manufacture with regard to both materials and labor, and which accordingly is then susceptible of low prices of sale to the consuming public, thereby making such wind dampening device economically available to the buying public.

Still yet another object of the present invention is to provide a new wind dampening device which provides in the apparatuses and methods of the prior art some of the advantages thereof, while simultaneously overcoming some of the disadvantages normally associated therewith.

Still another object of the present invention is to provide a new wind dampening device for dampening the wind around the ear associated with traveling at high velocities.

Yet another object of the present invention is to provide a new wind dampening device which includes a panel. The panel has a top edge, a front edge, a back edge, a facing side and a rear side. The panel generally has a triangular shape. The top and front edges are orientated generally perpendicular to each other. The rear side of the proximal portion is concave. A fastening means fastens the panel to the article.

Still yet another object of the present invention is to provide a new wind dampening device that dampens sound caused by wind moving about the ear of a person and in doing so resists damage to the ear caused by such sound.

Even still another object of the present invention is to provide a new wind dampening device that may be easily removed from the head apparatus of the user.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
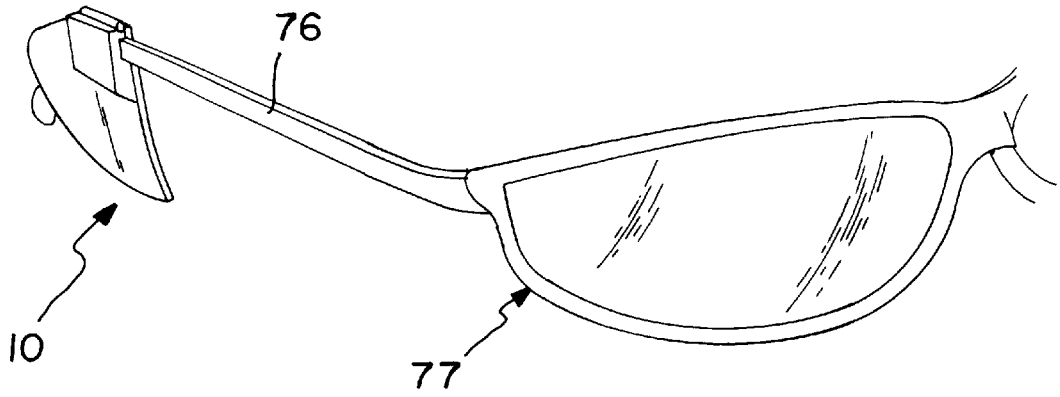
FIG. 1 is a schematic perspective view of a new wind dampening device according to the present invention.
Figure 2:
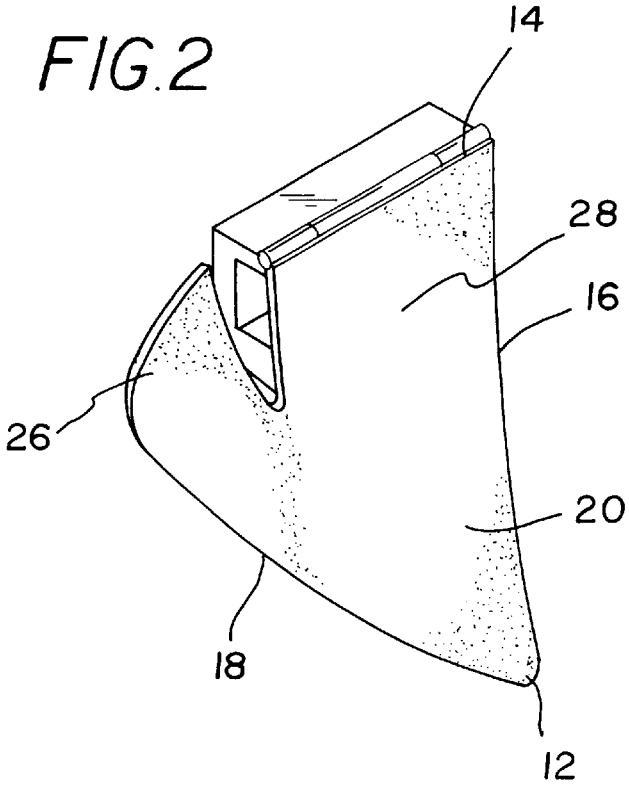
FIG. 2 is a schematic front perspective view of the present invention.
Figure 3:
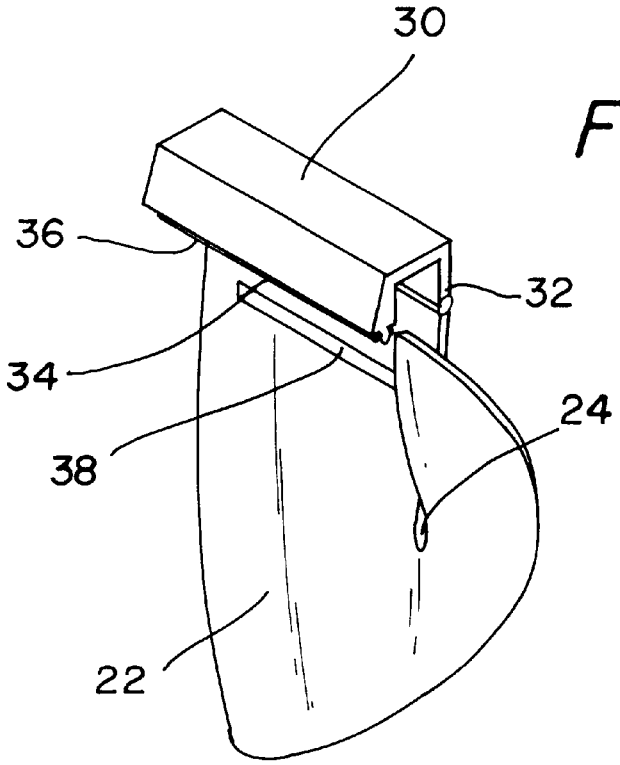
FIG. 3 is a schematic rear perspective view of the present invention.
Figure 4:
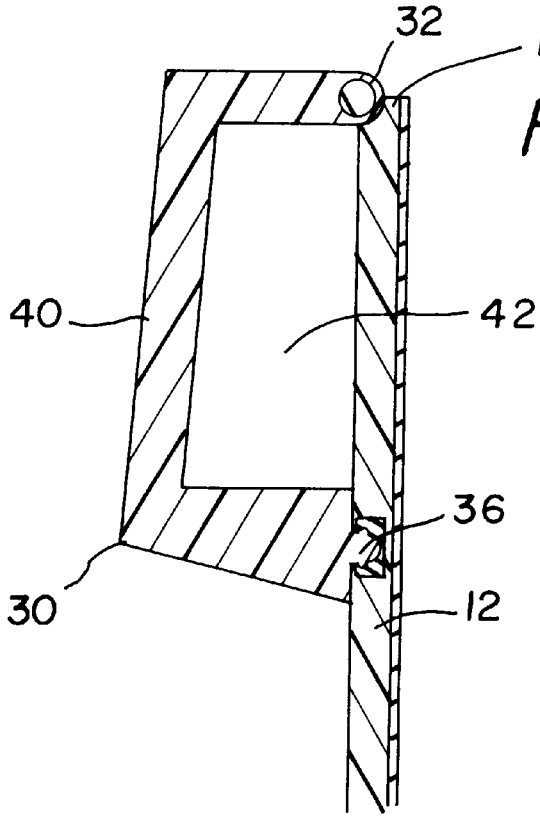
FIG. 4 is a schematic side cross-sectional view of the present invention.

With reference now to the drawings, and in particular to FIGS. 1 through 6 thereof, a new wind dampening device embodying the principles and concepts of the present invention and generally designated by the reference numeral 10 will be described.

As best illustrated in FIGS. 1 through 6, the wind dampening device 10 generally comprises a panel. The panel 12 has a top edge 14, a front edge 16, a back edge 18, a facing side 20 and a rear side 22. The panel 12 generally has a triangular shape. The top 14 and front edges 16 are orientated generally perpendicular to each other. A juncture of the top 14 and back 18 edges is generally rounded. The top edge 14 of the first embodiment shown in FIGS. 1 through 4 has a slot 24 therein. The first embodiment is for placement on the temple member 76 of a pair of glasses 77, the glasses being sunglasses, or any other form of conventional eyewear. The slot 24 extends from a central area of the top edge 14 generally toward a midpoint of the back edge 18 such that a distal portion 26 and proximal portion 28 are defined. The distal portion 26 is located generally between the back edge 18 and the slot 24. The distal portion 26 is bent out of a plane of the proximal portion 28, and is curved away from the facing side 20 and toward the rear side 22. The rear side 22 of the proximal portion 28 is concave primarily adjacent to the juncture of the front edge 16 and the back edge 18. The panel 12 preferably comprises a plastic.

A fastening means fastens the panel 12 to the temple member 76. The fastening means includes a bracket 30. The bracket 30 has a first edge 32 hingedly coupled to the top edge 14 of the panel 12. A second edge 34 of the bracket 30 has a protruding member 36 thereon. The protruding member 36 preferably extends along at least one half of the length of the second edge 34.

The panel 12 has an aperture 38 therein. The aperture 38 is positioned such that the protruding member 36 may be removably insertable in the aperture 38. The fastening means comprises a conventional snap type fastening means.

A middle portion 40 of the bracket 30 between the first 32 and second edges 34 is bowed such that a space 42 is defined between the middle portion 40 and the panel 12 when the protruding member 36 is inserted in the aperture 38. A portion of the temple member 76 of the glasses 77 may be removably fastened in the space 42 between the middle portion of the bracket and the panel.

Figure 5:
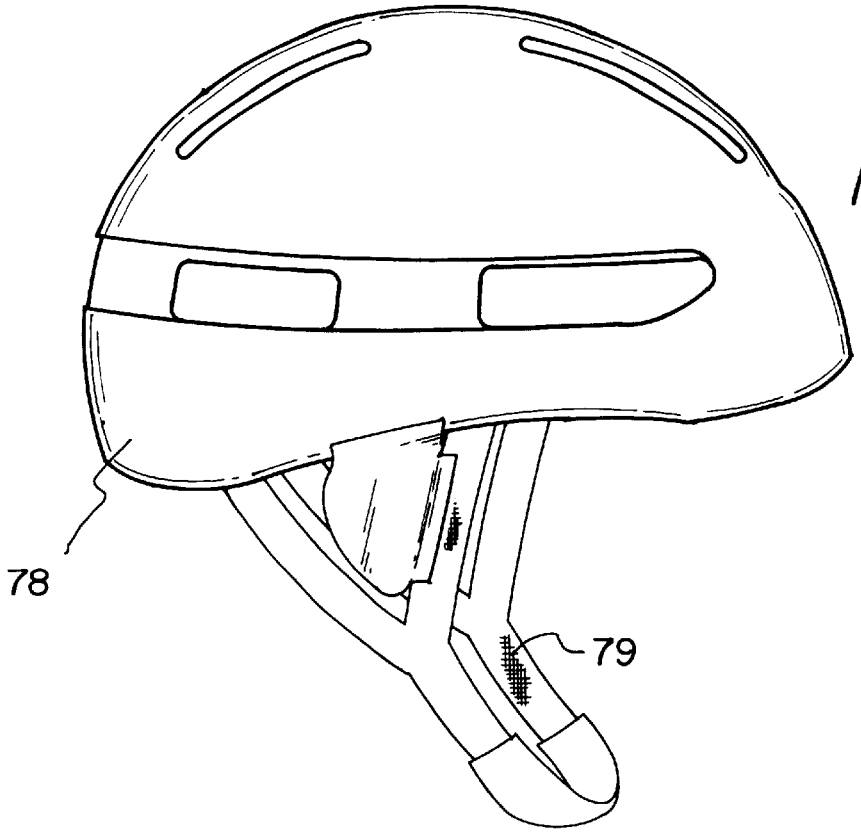
FIG. 5 is a schematic side perspective view of the helmet and second embodiment of the present invention.
Figure 6:
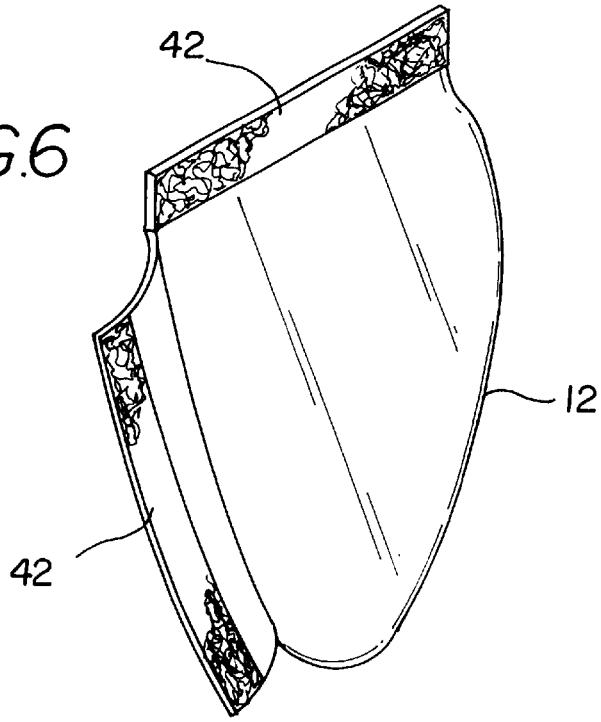
FIG. 6 is a schematic perspective rear view of the second embodiment of the present invention.

In the second embodiment, shown in FIGS. 5 and 6, the panel 12 has a pair of tabs 42. The tabs 42 have the hook portion of a hook and loop fastening means thereon. The tabs 42 are located on the top 14 and front edges 16 and are angled toward the rear side 22 of the panel 12. The second embodiment is for placement on a helmet 78. The helmet 78 and its chinstrap 79 have the loop portions thereon such that when the hook and loop portions are abutted against each other, the panel 12 is over the ear of the wearer of the helmet 78.

In use, a biker or other person who is traveling at a high rate of speed and having their ears exposed to the wind while doing such will be subject to high volumes of wind noise. The device is placed on glasses or the helmet to resist movement of air about the ears. The distal portion 26 of the first embodiment prevents air from moving behind the ear and thus dampens the wind and the sound associated therewith. The panel 12 is curved so that it conforms to the user of the face to further prevent air movement.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A wind dampening device, said device being removably fastenable to an article securable to a head of a person, said device comprising:

a panel, said panel having a top edge, a front edge and a back edge, said panel having a facing side and a rear side, said panel generally having a triangular shape, said top edge and said front edge being orientated generally perpendicular to each other, said rear side of said panel being concave;

a fastening means for fastening said panel to the article; and said top edge having a slot therein, said slot extending from a central area of said top edge generally toward a midpoint of said back edge such that a distal portion and proximal portion are defined, wherein said distal portion is located generally between said back edge and said slot, said distal portion being bent out of a plane of said proximal portion, said distal portion being curved away from said facing side and toward said rear side;

wherein said article comprises a pair of glasses.

2. The wind dampening device as in claim 1, wherein said fastening means comprises a bracket hingedly coupled to said top edge of said panel.

3. The wind dampening device as in claim 2, wherein said fastening means further comprises:

said bracket having a first edge hingedly coupled to said top edge of said panel, said bracket having a second edge opposite of said first edge, said second edge having protruding member thereon;

said panel having an aperture therein, said aperture being positioned such that said protruding member may be removably insertable in said aperture; and wherein a middle portion of said bracket between said first and second edges being bowed such that a space is defined between said middle portion and said panel when said protruding member is inserted into said aperture.

4. A wind dampening device, said device being removably mountable to a temple member of a pair of glasses, said device comprising:

a panel, said panel having a top edge, a front edge and a back edge, said panel having a facing side and a rear side, said panel generally having a triangular shape, said top edge and said front edge being orientated generally perpendicular to each other, a juncture of said top and back edges being generally rounded, said top edge having a slot therein, said slot extending from a central area of said top edge generally toward a midpoint of said back edge such that a distal portion and proximal portion are defined, wherein said distal portion is located generally between said back edge and said slot, said distal portion being bent out of a plane of said proximal portion, said distal portion being curved away from said facing side and toward said rear side, said rear side of said proximal portion being concave, said panel comprising a plastic;

a fastening means for fastening said panel to said temple member, said fastening means comprising:

a bracket, said bracket having a first edge hingedly coupled to said top edge of said panel, said bracket having a second edge opposite of said first edge, said second edge having protruding member thereon;

said panel having an aperture therein, said aperture being positioned such that said protruding member may be removably insertable in said aperture;

wherein a middle portion of said bracket between said first and second edges being bowed such that a space is defined between said middle portion and said panel when said protruding member is inserted into said aperture; and wherein a portion of the temple member may be removably fastened in said space between said middle portion of said bracket and said panel.

5. A wind dampening device for removably fastening to an article securable to a head of a person, said device comprising:

a panel having a top edge, a front edge and a back edge, said panel having a facing side and a rear side, said top edge and said front edge being orientated generally perpendicular to each other, said rear side of said panel being concave;

a fastening means for fastening said panel to the article;

wherein said top edge has a slot therein, said slot extending from a central area of said top edge generally toward a midpoint of said back edge such that a distal portion and proximal portion are defined, wherein said distal portion is located generally between said back edge and said slot, said distal portion being bent out of a plane of said proximal portion, said distal portion being curved away from said facing side and toward said rear side; and wherein said article comprises a pair of glasses.

6. The wind dampening device as in claim 5, wherein said fastening means comprises a bracket hingedly coupled to said top edge of said panel.

7. The wind dampening device as in claim 6, wherein said bracket has a first edge hingedly coupled to said top edge of said panel, said bracket having a second edge opposite of said first edge, said second edge having protruding member thereon, said panel having an aperture therein, said aperture being positioned such that said protruding member may be removably insertable in said aperture, and a middle portion of said bracket between said first and second edges being bowed such that a space is defined between said middle portion and said panel when said protruding member is inserted into said aperture.

* * * * *